US009233277B1

(12) United States Patent
Krull

(10) Patent No.: US 9,233,277 B1
(45) Date of Patent: Jan. 12, 2016

(54) EXERCISE BENCH METHODS AND APPARATUS

(71) Applicant: Mark A. Krull, New Braunfels, TX (US)

(72) Inventor: Mark A. Krull, New Braunfels, TX (US)

( * ) Notice: Subject to any disclaimer, the term of this patent is extended or adjusted under 35 U.S.C. 154(b) by 86 days.

(21) Appl. No.: 13/789,961

(22) Filed: Mar. 8, 2013

Related U.S. Application Data

(60) Provisional application No. 61/686,898, filed on Apr. 13, 2012.

(51) Int. Cl.
*A63B 26/00* (2006.01)
*A63B 22/00* (2006.01)
*A63B 71/00* (2006.01)

(52) U.S. Cl.
CPC ..... *A63B 26/00* (2013.01)

(58) Field of Classification Search
CPC ..... A63B 21/012; A63B 21/0125; A63B 21/015; A63B 22/00; A63B 22/116; A63B 22/0056; A63B 26/003
USPC ..... 482/51, 55–56, 91, 114–119, 142, 482/146–147
See application file for complete search history.

(56) References Cited

U.S. PATENT DOCUMENTS 3,759,511 A * 9/1973 Zinkin ..... A63B 21/015 297/423.1
4,674,740 A * 6/1987 Iams ..... A63B 69/10 482/111
5,545,115 A * 8/1996 Corcoran ..... A63B 22/16 482/146
5,860,899 A * 1/1999 Rassman ..... A61H 1/0222 482/131
5,913,759 A * 6/1999 Bostrom ..... A61H 1/0255 482/131
6,350,221 B1 * 2/2002 Krull ..... A63B 21/072 482/108
6,471,624 B1 * 10/2002 Voris ..... A63B 21/00047 482/136
6,652,432 B2 * 11/2003 Smith ..... A63B 26/003 482/146
6,666,797 B1 * 12/2003 Martin ..... A63B 69/0093 482/146
6,994,661 B1 * 2/2006 Dawson ..... A63B 21/00047 482/146
7,090,628 B2 * 8/2006 Badarneh ..... A63B 22/16 482/140
7,601,103 B2 * 10/2009 Chen ..... A63B 69/10 434/254
7,942,797 B1 * 5/2011 Canton ..... A63B 22/16 482/146
2004/0102295 A1 * 5/2004 Badarneh ..... A63B 22/16 482/140
2005/0137068 A1 * 6/2005 Boland ..... A63B 23/0216 482/140
2006/0270536 A1 * 11/2006 Tukada ..... A63B 26/003 482/146
2007/0179022 A1 * 8/2007 Chen ..... A63B 69/0093 482/51
2007/0207900 A1 * 9/2007 Huang ..... A63B 26/003 482/51
2007/0254789 A1 * 11/2007 Odien ..... A63B 22/16 482/146
2009/0197748 A1 * 8/2009 Smith ..... A63B 21/0004 482/146
2013/0053228 A1 * 2/2013 Winegar ..... A63B 22/16 482/146
2013/0252792 A1 * 9/2013 Brown ..... A63B 22/16 482/146
2014/0011651 A1 * 1/2014 Brown ..... A63B 22/16 482/146
2014/0221169 A1 * 8/2014 Bourne ..... A63B 69/06 482/72

* cited by examiner

*Primary Examiner* — Stephen Crow
*Assistant Examiner* — Garrett Atkinson

(57) ABSTRACT

An exercise assembly includes a bench sized and configured to support the back of a supine person. In a first mode of operation, the bench is structurally supported in a fixed, upwardly facing orientation relative to an underlying floor surface. The structural support is selectively removed by the person to switch to a second mode of operation, in which the bench is tiltable laterally relative to the underlying floor surface. Left and right pivot poles are mounted on one end of the bench and selectively pivoted back and forth by the feet of the person lying supine on the bench.

21 Claims, 12 Drawing Sheets

EXERCISE BENCH METHODS AND APPARATUS

CROSS-REFERENCE TO RELATED APPLICATION

Disclosed herein is subject matter entitled to the filing date of U.S. Provisional No. 61/686,898, filed Apr. 13, 2012.

FIELD OF THE INVENTION

The present invention relates to exercise bench methods and apparatus for exercising muscles of the human body.

BACKGROUND OF THE INVENTION

An object of the present invention is to provide improved exercise methods and/or apparatus.

SUMMARY OF THE INVENTION

In one mode of operation, a person lies supine on a bench that is supported in a fixed, upwardly facing orientation on an underlying floor surface. Left and right pivot arms or poles are pivotally mounted on an end of the bench, and the person selectively uses his left and right feet to move respective poles back and forth. The person also has the option of performing abdominal exercises on the bench and/or weight lifting exercises on the bench.

In another mode of operation, a person lies supine on the bench with the bench free to tilt laterally relative to the underlying floor surface. While using his hands to exert downward force against the floor surface to stabilize the bench, the person selectively uses his left and right feet to move respective poles back and forth. The person also has the option of performing weight lifting exercises while pressing his left and right feet against the floor surface to stabilize the bench.

A preferred embodiment of the present invention includes selectively deployable legs adjustably connected to the bench and selectively deployable handles removably connected to the bench. The legs selectively telescope into opposite ends of a tube proximate the same end of the bench as the pivot poles. The legs also selectively rotate between a stabilizing orientation and a de-stabilizing orientation relative to the tube. On one embodiment, the handles selectively telescope into opposite ends of a tube proximate an intermediate portion of the bench, and they also selectively rotate between a stabilizing orientation and a de-stabilizing orientation relative to the tube. On another embodiment, different handles selectively underlie the bench, and they may be orientated to resist withdrawal from beneath the bench or accommodate withdrawal from beneath the bench.

Both sets of handles are also selectively removable from the bench by a person lying supine on the bench, and thereafter, may be selectively re-engaged with the bench by the person lying supine on the bench. As a result, the person may switch between the two modes of operation described above, and/or assume a ready position on the bench before switching to the second mode of operation described above. Both sets of the handles may also be used in the second mode of operation for purposes of exerting force against the underlying floor surface.

Many features and advantages of the present invention will become apparent from the more detailed description that follows.

BRIEF DESCRIPTION OF THE DRAWING

With reference to the Figures, which are drawn to scale, and wherein like numerals represent like parts and assemblies throughout the several views.

DETAILED DESCRIPTION OF THE PREFERRED EMBODIMENT

Figure 1:
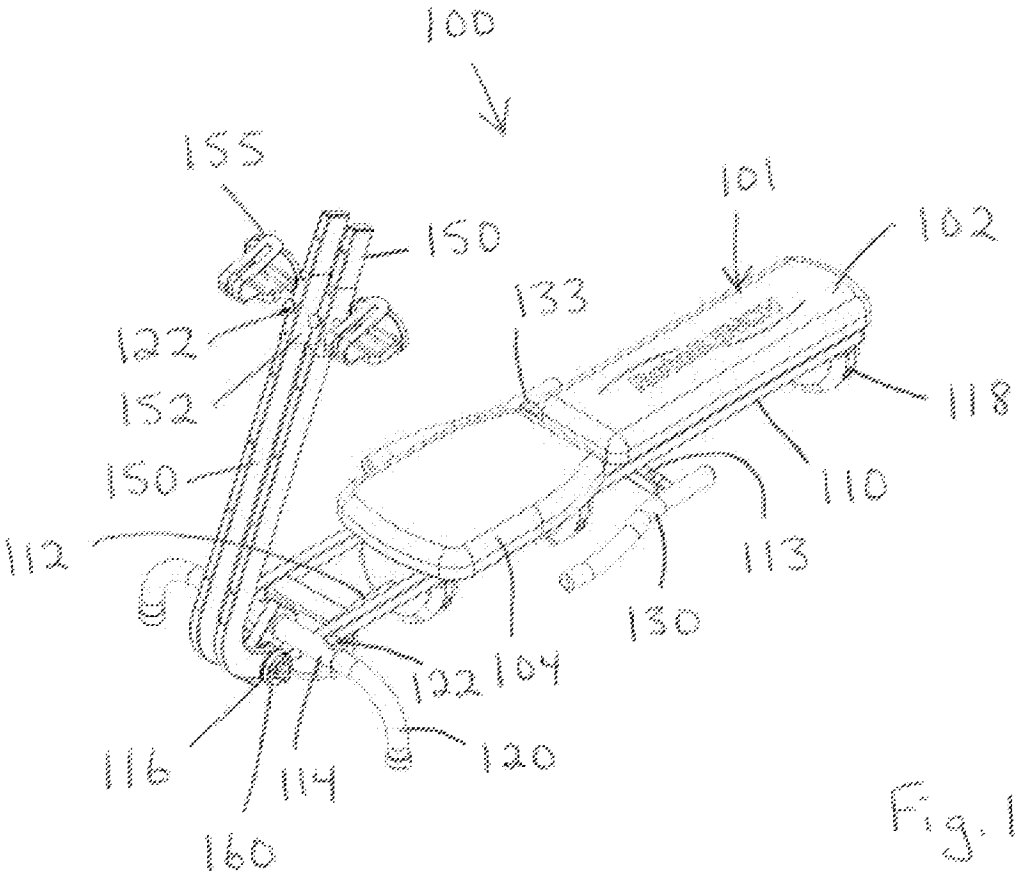
FIG. 1 is a perspective view of a first exercise assembly constructed according to the principles of the present invention and configured in a first manner.
Figure 2:
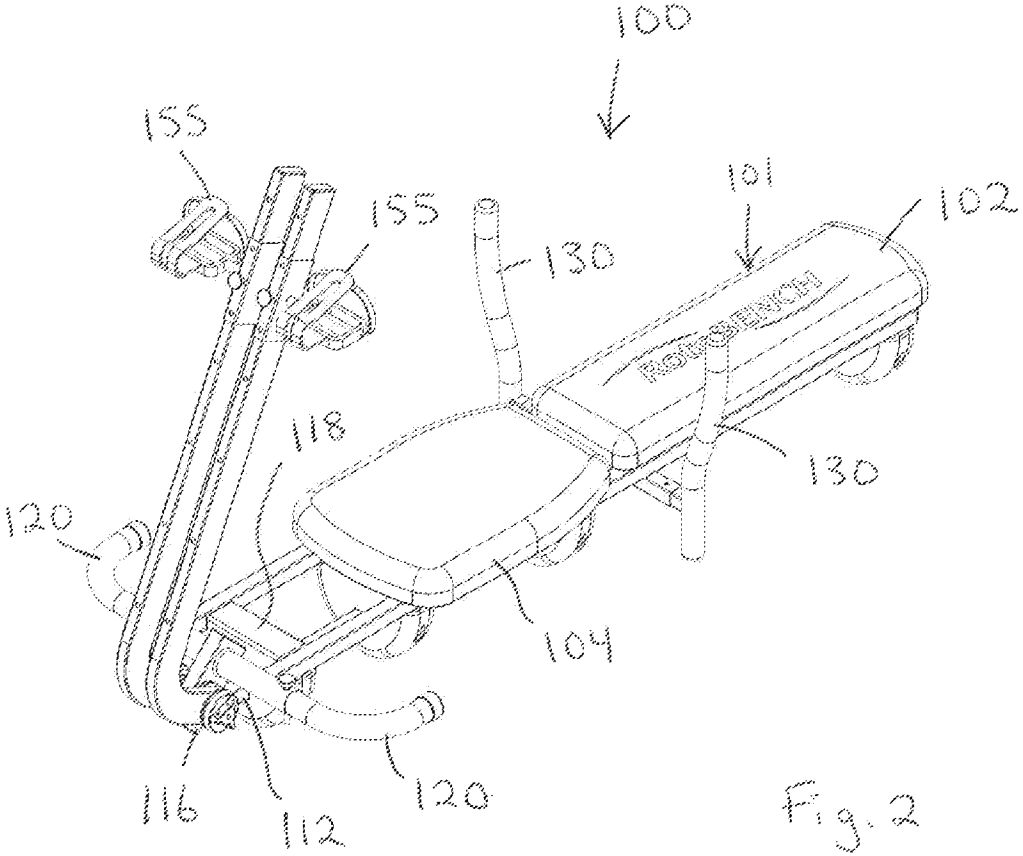
FIG. 2 is a perspective view of the exercise assembly of FIG. 1 configured in a discrete, second manner.

A first exercise assembly constructed according to the principles of the present invention is designated as 100 in FIGS. 1-2 and 3*a*-3*e*. Generally speaking, the exercise assembly 100 may be described in terms of a tiltable bench 101, left and right legs 120 operatively connected to a foot end of the bench 101, left and right handles and/or stops 130 releasably bracing respective sides of the bench 101 against tilting, left and right pivot arms or poles 150 pivotally mounted on the foot end of the bench 101, and left and right pedals 155 operatively mounted on respective poles 150.

The bench 101 includes a back pad 102 sized and configured to underlie the spine and head of a person lying supine on the bench 101, and a seat pad 104 sized and configured to underlie the entire buttocks of a person lying supine on the bench 101. On the embodiment 100, the back pad has a length of 28 inches and a width of 8 inches, and the seat pad has a length of 14 inches and a maximum width of 12 inches. Each pad 102 and 104 is manufactured in a manner already known in the art, and preferably includes an intermediate cushion layer enclosed between a lower plywood layer and an upper upholstery layer. On alternative embodiments, the pads 102 and 104 may be integrally formed as a single part, and/or manufactured by molding self-skinning foam rubber onto an underlying structure of plywood or plastic, or blow-molded in its entirety.

The pads 102 and 104 are secured to left and right underlying reinforcing bars 110 by screws or other means known in the art. The bars 110 extend almost the entire length of the assembly 100 and are preferably square steel tubes. Proximate a foot end of the assembly 100, the bars 110 are connected to a transverse member 114 by welding or other means known in the art. The transverse member 114 is preferably a cylindrical steel tube that measures one foot in length.

Each leg 120 is preferably a cylindrical steel tube that has been bent to form a 90 degree angle or elbow, thereby creating a generally L-shaped configuration. A relatively longer segment of each leg 120 is selectively inserted into a respective end of the transverse member 114, and selectively secured in place by a conventional detent pin 122 inserted through aligned holes in the leg 120 and the transverse member 114. An opposite, relatively shorter segment of each leg 120 is configured to engage an underlying floor surface when arranged as shown in FIGS. 1 and 3*d*-3*e*. In this regard, a plastic end cap and/or plug is preferably fitted onto/into the distal end of the leg 120. Alternative holes are provided in the legs 120 to accommodate respective pins 122 when the legs are rotated to the orientations shown in FIGS. 2 and 3*a*-3*c*. The legs 120 are present on the preferred embodiment, but are not critical to practicing certain aspects of the present invention, and thus, are not present on certain alternative embodiments.

A rectangular steel tube segment or support 116 is rigidly secured to an intermediate portion of the transverse member 114. On the preferred embodiment 100, the transverse member 114 extends through a hole in the support 116, and the proximate material of the two components is welded together. Another reinforcing bar 112 has a first end that is welded to a relatively lower portion of the support 116. The bar 112 extends almost the entire length of the assembly 100 and is preferably a square steel tube like the bars 110.

At four longitudinally spaced locations along the assembly 100, respective rockers 118 are fitted onto the bar 112 and rigidly secured in place directly beneath the bars 110 and the pads 102 and 104. Each rocker 118 is preferably a blow-molded plastic part having a flat upwardly facing top wall, and a convex downwardly facing bottom wall. In the absence of other floor engaging structure, including the legs 120, the rockers 118 support the bench 101 approximately six inches above an underlying floor surface subject to lateral tilting to the left or right.

Another transverse member 113 is rigidly secured to intermediate portions of the bars 110 at a location beneath the back pad 102 and proximate the seat pad 104. The transverse member 113 is preferably a square steel tube like the bars 110. The left and right handles and/or stops 130 have respective square pegs or stems 133 that are selectively inserted into respective ends of the transverse member 113, and selectively secured in place by a conventional detent pin 122 inserted through aligned holes in the stems 133 and the transverse members 113. First holes in the stems 133 accommodate the handles 130 in the orientation shown in FIGS. 1 and 3*a* and 3*e*. Alternate, second holes in the stems 133 accommodate the handles 130 in the orientation shown in FIGS. 2 and 3*c*-3*d*. On an alternative embodiment, members with circular profiles may be substituted for the transverse member 113 and the stems 133, if desired.

Each handle 130 is preferably a cylindrical steel tube that has been bent, capped at the ends, and coated in rubber to arrive at the configuration shown in the accompanying Figures. An upper end of each handle 130 is sized and configured for grasping in a person's hand, and may be described as a handhold and/or a handlebar (recognizing that it can be hollow or solid and/or steel or some other material). Each handhold or handlebar segment is preferably at least five inches long and one inch in diameter. An opposite, lower end of each handle 130 is configured to engage an underlying floor surface.

With reference back to the support 116, the left and right pivot arms or poles 150 are disposed on opposite sides of the support 116, and a lower end of each pivot pole 150 is pivotally mounted on the support 116 for pivoting about a common, transversely extending axis. Each pivot pole 150 is preferably a steel tube having a rectangular profile. A ninety degree bend is formed in each pivot pole 150 to accommodate storage of the pivot poles 150 against the seat pad 104. In this regard, the bend in each pivot pole 150 provides clearance relative to the transverse support 114.

A left pedal assembly 155 is selectively mounted on the left pivot pole 150, and a right pedal assembly 156 is selectively mounted on the right pivot pole 150. Each pedal assembly 155 and 156 preferably includes a bracket 157, a shaft that projects laterally outward from an outer side of the bracket 157, a foot platform rotatably mounted on the shaft, and a toe cup and/or strap connected to at least one of the foot platform and the shaft. Each bracket 157 is preferably a steel tube segment having a rectangular profile sized and configured to slide along a respective pivot pole 150. An optional plastic bushing is preferably disposed between each bracket 157 and a respective pivot pole 150. Conventional detent pins 122 are inserted through aligned holes in respective brackets 157 and respective pivot poles 150 to selectively lock the pedal assemblies 155 and 156 in any of several available positions along the pivot poles 150. The other pedal assembly components are preferably conventional off-the-shelf parts. On certain alternative embodiments, the pedal assemblies 155 are replaced by simple cylindrical pegs and accompanying foot straps that are rotatably mounted together on respective pivot poles.

The resistance assembly 160 preferably includes multiple discs of discrete types of material disposed on opposite sides of each pivot pole 150 and selectively compressed to establish a smooth and moderate level of resistance to pivoting of the poles 150. For example, the depicted resistance assembly 160 preferably includes a group of at least two different conventional friction discs on each side of each pivot pole 150. A carriage bolt is inserted through all of the discs, as well as the support 116 and the ends of the pivot poles 150. The carriage bolt has a longitudinal axis that coincides with the pivot axis associated with the pivot poles 150. A first knob is secured to the head end of the carriage bolt, and a second knob is threaded onto the opposite end of the bolt, thereby sandwiching the support 116 between the left and right pivot poles 150. The knobs are rotated relative to one another in a first manner to increase compression of the components disposed therebetween, thereby increasing resistance to pivoting of the pivot poles 150. Conversely, the knobs are rotated relative to one another in an opposite, second manner to decrease compression of the components disposed therebetween, thereby decreasing resistance to pivoting of the pivot poles 150.

Figure 3A:
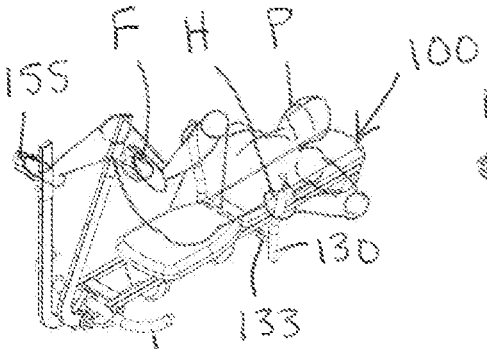
FIGS. 3*a*-3*e* are perspective views of a person using the exercise assemblies of FIGS. 1 and 2.

FIG. 3*a* shows a person P lying supine on the exercise assembly 100 with his back and head supported on the back pad 102 and his posterior supported on the seat pad 104. The legs 120 are pivoted to a de-stabilizing orientation relative to the bench 101 (out of contact with the underlying floor surface). The handles 130 are arranged in a stabilizing orientation relative to the bench 101 (vertical with the stems 133 inserted into respective ends of the tube 113 and the handlebar segments extending vertically). The person P places his left and right feet F into respective pedals 155, and grasps the upper ends of the left and right handles 130 in his respective hands H. The person P then moves the left and right pedals 155 back and forth in reciprocating fashion about the pivot axis defined by the resistance assembly 160, while the handles 130 (acting as stops) maintain the bench 101 in a stable orientation relative to the floor surface.

Figure 3B:
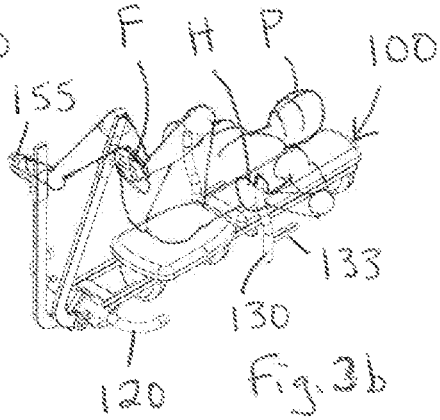

FIG. 3*b* shows a person P lying supine on the exercise assembly 100 with his back and head supported on the back pad 102 and his posterior supported on the seat pad 104. As in FIG. 3*a*, the legs 120 are pivoted to a de-stabilizing orientation relative to the bench 101 (out of contact with the underlying floor surface). Contrary to FIG. 3*a*, the handles 130 are arranged in a de-stabilizing orientation relative to the bench 101 (the stems 133 have been removed from respective ends of the tube 113). The person P places his left and right feet F into respective pedals 155, and grasps the upper ends of the left and right handles 130 in his respective hands H. The person P then moves the left and right pedals 155 back and forth in reciprocating fashion about the pivot axis defined by the resistance assembly 160. The person P uses his hands H to exert downward force against the floor surface in order to stabilize the bench 101 relative to the floor surface.

Figure 3C:
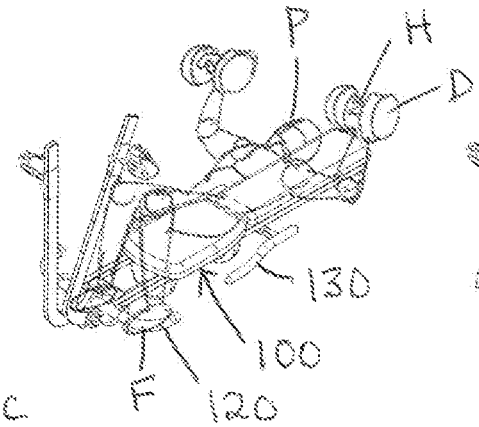
Figure 3D:
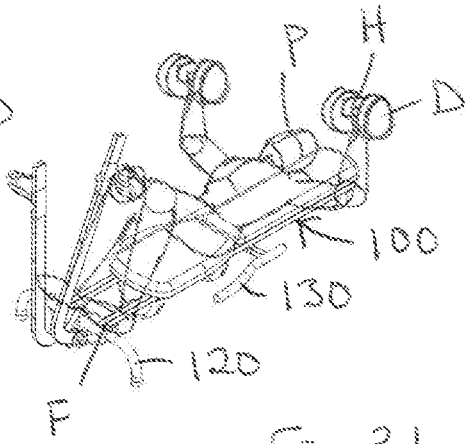
Figure 3E:
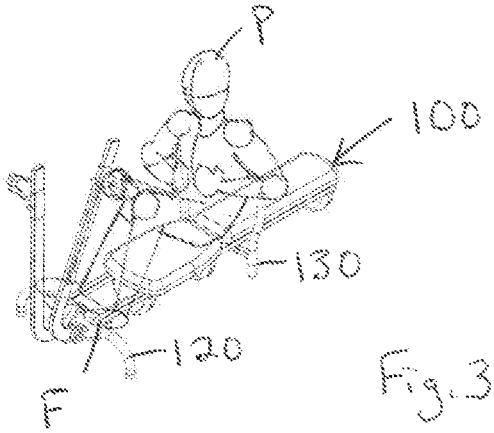

FIG. 3*c* shows a person P lying supine on the exercise assembly 100 with his back and head supported on the back pad 102 and his posterior supported on the seat pad 104. As in FIG. 3*b*, the legs 120 are pivoted to a de-stabilizing orientation relative to the bench 101 (out of contact with the underlying floor surface). Contrary to FIG. 3*b*, the handles 130 are arranged in a different de-stabilizing orientation relative to the bench 101 (horizontal with the stems 133 inserted into respective ends of the tube 113 and the handlebar segments extending horizontally). The person P places his left and right feet F on the floor surface and holds left and right dumbbells D in his respective hands H. The person P moves the dumbbells D up and down in a bench press motion, while using his feet F to exert downward force against the floor surface in order to stabilize the bench 101 relative to the floor surface.

FIG. 3*d* shows a person P lying supine on the exercise assembly 100 with his back and head supported on the back pad 102 and his posterior supported on the seat pad 104. Contrary to FIG. 3*c*, the legs 120 are pivoted to a stabilizing orientation relative to the bench 101 (bearing against the underlying floor surface), and as such may be referred to as stops that brace the bench against tilting. The handles 130 are arranged the same as in FIG. 3*c*. The person P places his left and right feet F on the horizontal portions of the legs 120 and holds left and right dumbbells D in his respective hands H. The person P moves the dumbbells D up and down in a bench press motion, while the legs 120 maintain the bench 101 in a stable orientation relative to the floor surface.

FIG. 3*e* shows a person P lying supine on the exercise assembly 100 with his back and head supported on the back pad 102 and his posterior supported on the seat pad 104. As in FIG. 3*d*, the legs 120 are pivoted to a stabilizing orientation relative to the bench 101 (bearing against the underlying floor surface), and as such may be referred to as stops that brace the bench against tilting. The handles 130 are arranged the same as in FIG. 3*a*. The person P places his left and right feet F on the horizontal portions of the legs 120 and performs sit-ups, while the legs 120 and the handles 130 (acting as stops) maintain the bench 101 in a stable orientation relative to the floor surface.

Figure 4:
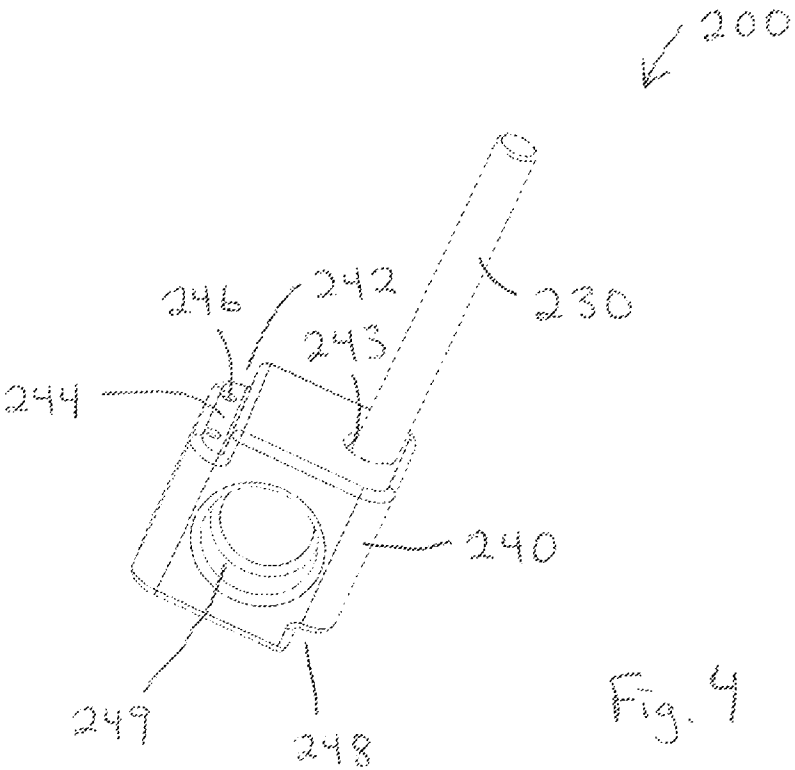
FIG. 4 is a perspective view of an alternative embodiment component suitable for use on a variation of the exercise assembly of FIG. 1.

FIG. 4 shows an alternative embodiment handle/stop combination 200 suitable for use on an alternative embodiment of the present invention. The handle/stop combination 200 includes a handlebar 230 selectively inserted into a stop 240. The handlebar 230 is preferably a cylindrical steel tube that is sized and configured for grasping in a person's hand. In a manner already known in the art, the handlebar 230 is fitted with end caps and/or plugs, and/or is vinyl dipped or rubber coated.

The stop 240 is preferably a blow molded plastic part having a generally cubic shape. A cylindrical bore 243 extends into a sidewall of the stop 240 to receive an end of the handlebar 230. Along two diametrically opposed corners of the cube, notches 242 and 248 are formed in the cube. Each of the notches 242 and 248 is configured and arranged to nest against a reinforcing bar 110 in order to resist tilting of the bench 101. In this regard, a ledge 244 is defined to directly underlie a reinforcing bar 110 when the bench 101 is parallel to the underlying floor surface. When the reinforcing bars 110 occupy the notches 242 in respective stops 240, the handlebars 230 extend vertically upward from the underlying floor surface. On the other hand, when the reinforcing bars 110 occupy the notches 248 in respective stops 240, the handlebars 230 extends parallel to the underlying floor surface.

Holes or recesses 246 extend into the ledge 244 (and the ledge associated with the notch 248) to selectively receive or interlock with complementary protruding structures or pegs extending downward from a dedicated location along a respective reinforcing bar 110 on the alternative embodiment. When the stops 240 are arranged to receive the pegs, the stops 240 are effectively latched in place and cannot be removed by a person lying on the bench 101. On the other hand, when the stops 240 are repositioned along the reinforcing bars 110 to avoid the pegs, then the stops 240 can be removed by a person lying on the bench 101. When the stops 240 are removed from the reinforcing bars 110, a person may use the handlebars 230 and/or the stops 240 to exert downward force against the floor surface for purposes of stabilizing the bench 101.

Among other things, persons skilled in the art will recognize that the stop 240 may be used without any associated handlebar 230. For example, centrally located, cylindrical recesses 249 extend into opposite sidewalls of the stop 240, and a person can place his thumb in one of the recesses 249 and one or more of his fingers in the other recess 249 to pull the stop 240 out from underneath a reinforcing bar 110.

Figure 5:
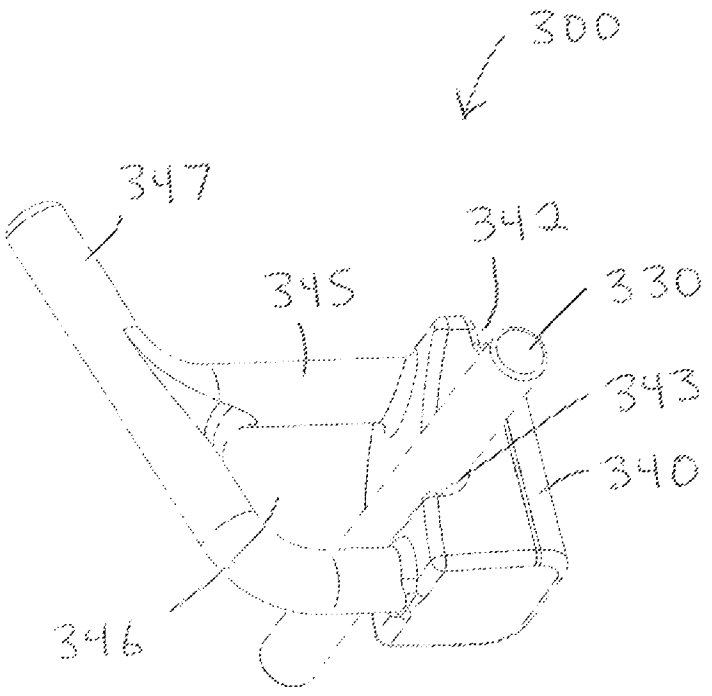
FIG. 5 is a perspective view of another alternative embodiment component suitable for use on a variation of the exercise assembly of FIG. 1.

FIG. 5 shows another alternative embodiment handle/stop combination 300 suitable for use on another alternative embodiment of the present invention. The handle/stop combination 300 includes a handlebar 330 selectively inserted into a stop 340. The handlebar 330 is preferably a cylindrical steel tube that is sized and configured for grasping. In a manner already known in the art, the handlebar 330 is fitted with end caps and/or plugs, and/or is vinyl dipped or rubber coated.

The stop 340 is preferably a blow molded plastic part having a block portion and a generally y-shaped portion. The y-shaped portion of the stop 340 includes a first handgrip 345 that extends horizontally away from the bench 101 when the notch 342 is accommodating a reinforcing bar 110, and a second handgrip 347 the extends upward and away from the bench 101 when the notch 342 is accommodating a reinforcing bar 110. The y-shaped portion cooperates with the block portion to define an opening 346 to accommodate grasping of the stop 340 by a person lying on the bench 101.

A semi-cylindrical notch 343 extends into a sidewall of the block portion to receive a segment of the handlebar 330. A notch 342 is defined along an upper edge of the block portion. The notch 342 is configured and arranged to nest against a reinforcing bar 110 in order to resist tilting of the bench 101. As on the previous embodiment 200, a ledge is defined to directly underlie a reinforcing bar 110 when the bench 101 is parallel to the underlying floor surface, and holes preferably extend into the ledge to selectively receive pegs extending downward from a dedicated location along a respective reinforcing bar 110 on the alternative embodiment. Also, a person may use the stop 340 apart from the handlebar 330, and/or the handlebar 330 apart from the stop 340.

Another exercise assembly constructed according to the principles of the present invention is designated as 400 in FIGS. 6-9. Generally speaking, the exercise assembly 400 is similar in construction and function to the first exercise assembly 100, and the following description will focus primarily on the differences (as well as some embellishments and variations that may apply to other embodiments, including the first embodiment 100). The exercise assembly 400 may be described in terms of a tiltable bench 101, left and right legs 420 operatively connected to a foot end of the bench 101, left and right handles and/or stops 440 releasably connected to respective sides of the bench 101, left and right pivot arms or poles 450 pivotally mounted on the foot end of the bench 101, and left and right pedals 155 operatively mounted on respective poles 450.

As suggested by the common reference numerals, the bench 101 is the same on both embodiments 100 and 400, and the pads 102 and 104 are similarly secured to left and right underlying reinforcing bars 110 by screws or other means known in the art, and the bars 110 are similarly connected to a transverse member 114.

Optional, generally L-shaped legs 420 are preferably telescopically engaged with respective ends of the transverse member 114. The legs 420 are similar to the legs 120, except that the shorter segments are not as long as the shorter segments on the legs 120 (because the bars 110 are not as high above the floor surface). A tubular steel bar segment or support 416 is rigidly secured to an intermediate portion of the transverse member 114. As on the preferred embodiment 100, the transverse member 114 extends through a hole in the support 416, and the proximate material of the two components is welded together.

At three longitudinally spaced locations along the assembly 400, respective rockers 418 are rigidly secured in place directly beneath the bars 110 and the pads 102 and 104. Each rocker 418 is preferably an injection molded plastic part having a flat upwardly facing and open top edge, and a convex downwardly facing and closed bottom edge. In the absence of other structure, including the legs 420, the rockers 418 support the bench 101 approximately four inches above an underlying floor surface subject to lateral tilting to the left or right (see FIG. 8).

Figure 6:
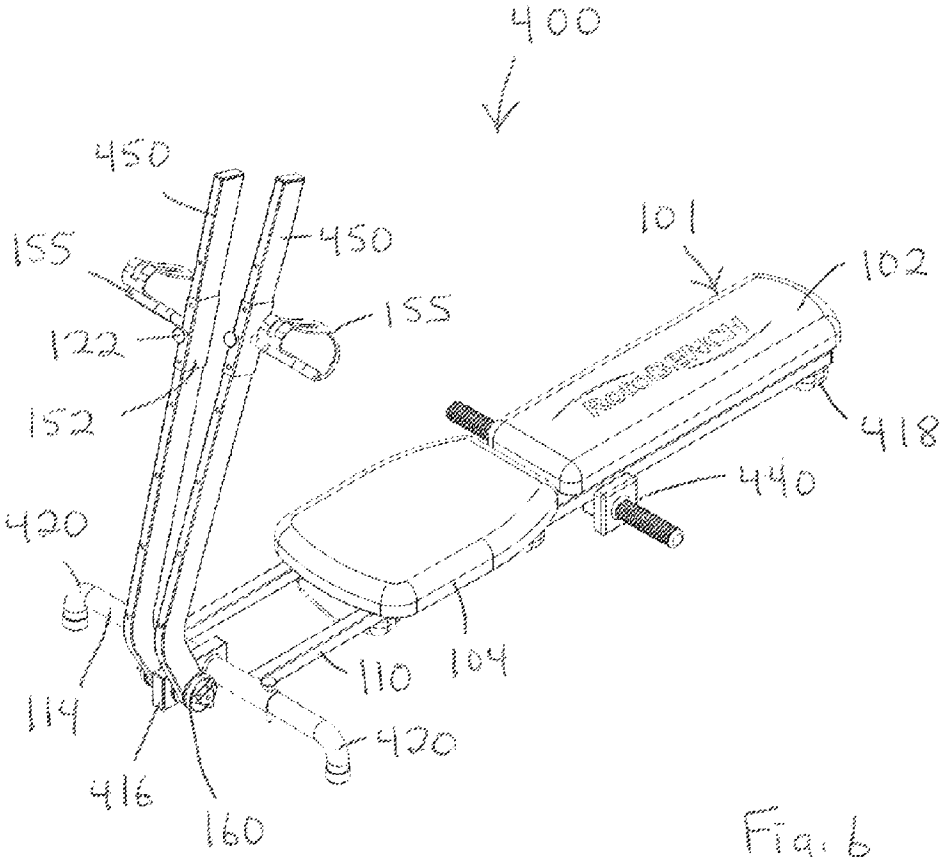
FIG. 6 is a perspective view of a second exercise assembly constructed according to the principles of the present invention and configured in a first manner.
Figure 7:
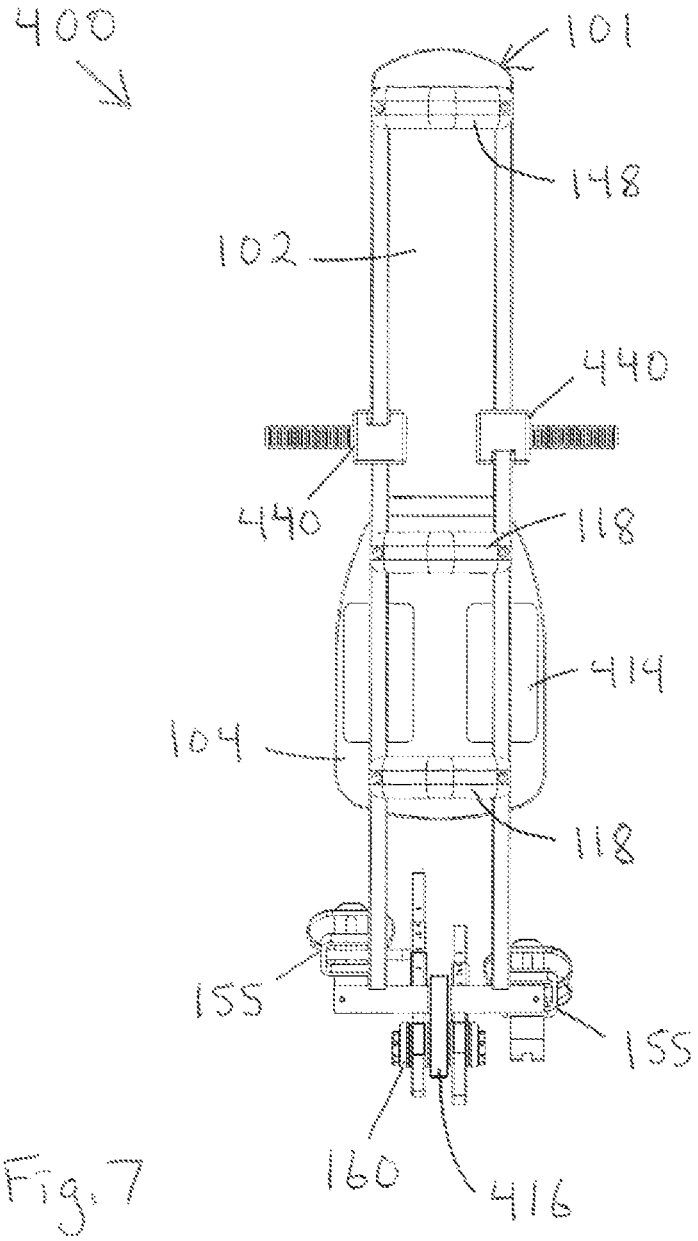
FIG. 7 is a bottom view of the exercise assembly of FIG. 6 configured in a discrete, second manner.
Figure 8:
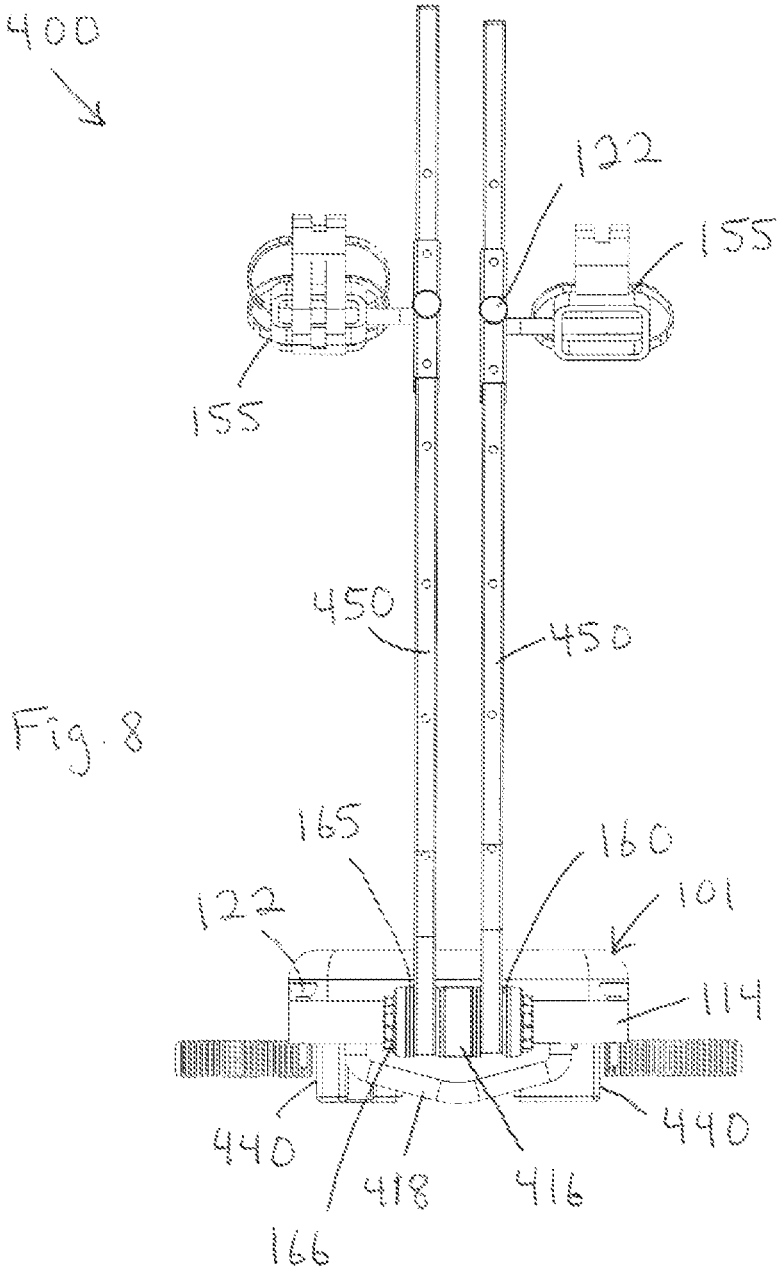
FIG. 8 is a front view of the exercise assembly of FIG. 7.

Each handle/stop 440 is preferably a blow-molded plastic part having a handgrip portion 443 that is sized and configured for grasping in a person's hand, and a block portion 444 that is connected to an end of the handgrip portion 443. The block portion 444 defines two recessed ledges 446 and 448 that extend perpendicular to one another. A catch or wall 447 projects outward from the ledge 446. When each handle/stop 440 is arranged as shown in FIG. 6, the left and right bars 110 rest on top of respective ledges 446, and laterally outboard relative to respective catches 447. As a result, each handle/stop 440 is selectively slidable along a respective bar 110, but trapped against transverse movement relative to a respective bar 110. When each handle/stop 440 is arranged as shown in FIGS. 7-8, the left and right bars 110 rest on top of respective ledges 448, and as a result, each handle/stop 440 is selectively slidable out from beneath a respective bar 110.

Figure 9:
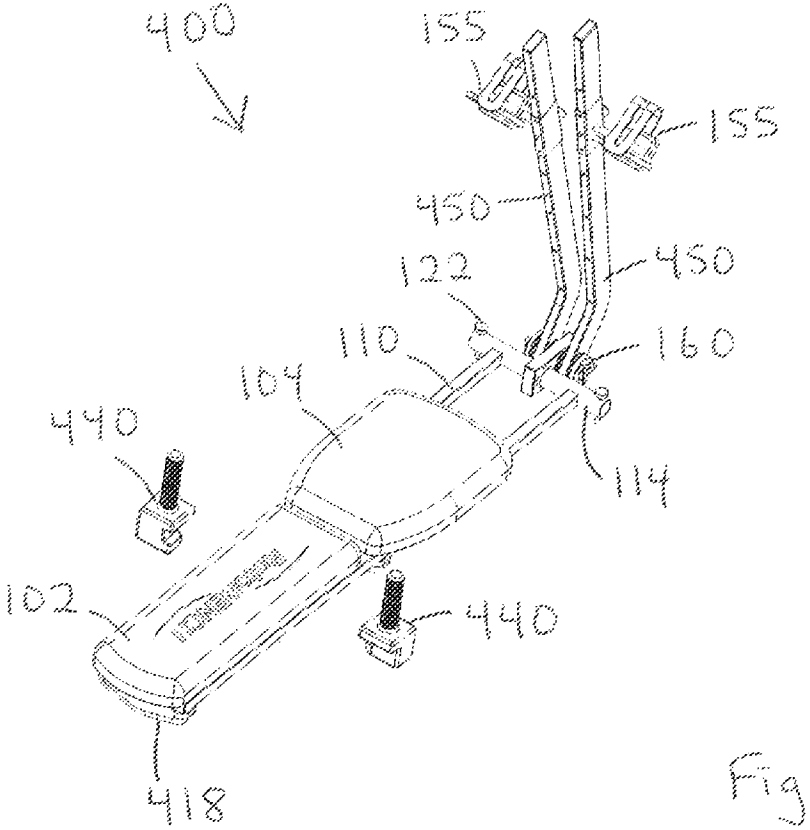
FIG. 9 is an alternative perspective view of the exercise assembly of FIG. 6 configured in a discrete, third manner.

FIG. 9 shows each handle/stop 440 in a third position, removed entirely from the bench 101 and oriented with the handgrips 443 extending vertically upward from the underlying floor surface. In this configuration, a person may use each handle/stop 440 in a respective hand to steady himself relative to the floor surface during certain exercises, including the one depicted in FIG. 3*b*, or alternatively, may simply press his hands directly against the floor surface for stabilization purposes. In other words, one aspect of the present invention may require both the handle portions 443 and the block portions 444, while other aspects of the present invention may involve using the block portions 444 without the handle portions 443, or using the handle portions 443 without the block portions 444, or not using any portions of the handle/stop members 440 in any capacity.

With reference back to the support 416, the left and right pivot poles 450 are disposed on opposite sides of the support 416, and a lower end of each pivot pole 450 is pivotally mounted on the support 416 for pivoting about a transverse axis. The pivot poles 450 are similar to the pivot poles 150, except that they are bent to a lesser extent. As suggested by the common reference numerals, similar left and right pedal assemblies 155 are selectively mounted on respective pivot poles 450.

As suggested by the common reference numeral, the same resistance assembly 160 is provided on the assembly 400. The resistance assembly 160 preferably includes multiple discs 165 of one or more of the following materials: polyethylene; polyoxymethylene; polypropylene; polyurethane; Kevlar; Teflon; UHMW; Nylon; polycarbonate; and leather. A carriage bolt is inserted through all of the discs, as well as the support 416 and the ends of the pivot poles 450. The carriage bolt has a longitudinal axis that coincides with the pivot axis associated with the pivot poles 450. A first knob 166 is secured to the head end of the carriage bolt, and a second knob is threaded onto the opposite, threaded end of the bolt. At least one of the knobs is rotated relative to the other knob in a first manner to increase compression of the components disposed therebetween, thereby increasing resistance to pivoting of the pivot poles 450. Conversely, at least one of the knobs is rotated relative to the other knob in an opposite, second manner to decrease compression of the components disposed therebetween, thereby decreasing resistance to pivoting of the pivot poles 450.

Figure 10:
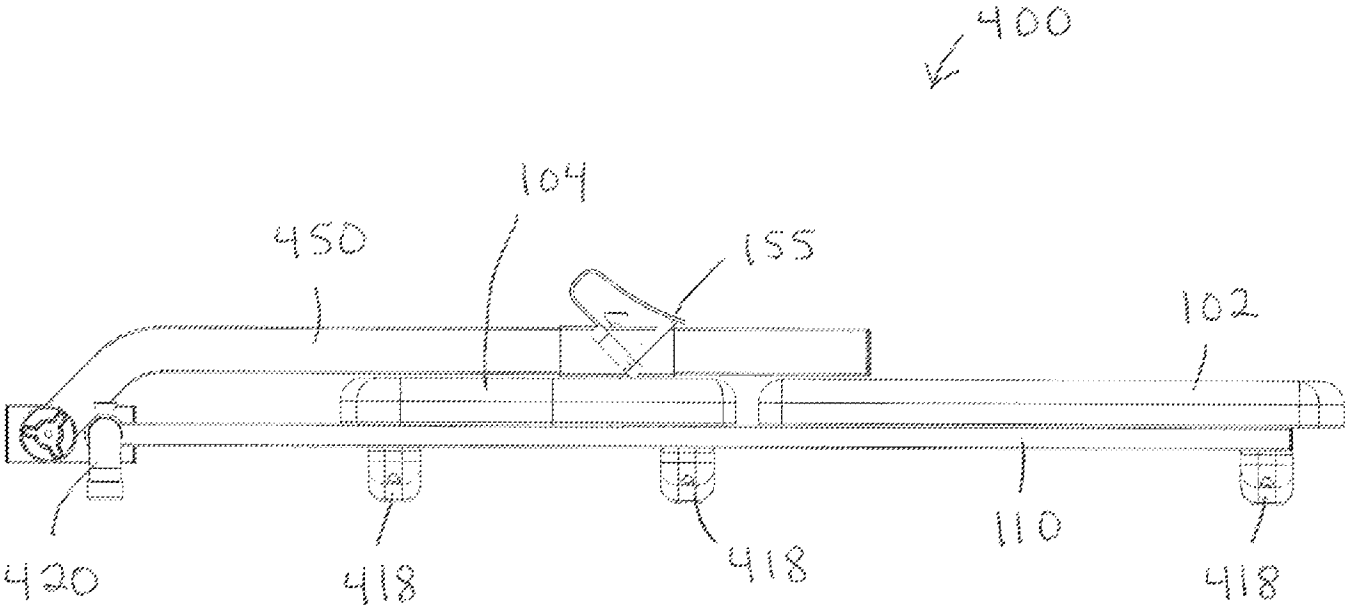
FIG. 10 is a side view of the exercise assembly of FIG. 6 configured in a discrete, fourth manner.

FIG. 10 shows the handles/stops 440 removed entirely from the assembly 400, and the poles 450 pivoted to a horizontal position lying on top of the bench 101. This configuration is well suited for shipping the product 400 fully assembled, and/or storing it when not in use. The foot pedal assemblies 155 are selectively movable toward the pivoting ends of the poles 450 to fully clear the seat pad 104, or in the opposite direction and off of the poles 450 to fully clear the back pad 102. The poles 450 are pivotal through a range of 180 degrees, from the position shown in FIG. 10 to a diametrically opposed position forward of the bench 101 and lying horizontal on the floor surface.

In a manner known in the art, transverse holes may be formed in the poles 450 to align and receive a conventional detent pin or other suitable fastener for purposes of locking the poles 450 together, and in other words, preventing relative pivoting of one pole 450 relative to the other pole 450. Similarly, transverse holes may be formed in the poles 450 and the support 416 (or other structure rigidly secured thereto) to align and receive a conventional detent pin or other suitable fastener for purposes of locking the poles 450 in a desired orientation to the frame member 416 (such as a vertical orientation), and in other words, preventing pivoting of the poles 450 relative to the frame member 416.

In a manner known in the art, an electronic user interface may be mounted on the support 416 (or other structure rigidly secured thereto) to measure exercise performance and/or to provide information to a person using the assembly 400. For example, the interface may include a timer and/or a display that shows information such as elapsed exercise time or cumulative number of exercise repetitions, and may generate visible and/or audible signals, as well. With regard to repetitions, a magnet may be secured to each pivot pole 450 at a common radial distance from the pivot axis, and a conventional sensor may be secured (directly or indirectly) to the support 416 at the same radial distance from the pivot axis to sense the passage of the magnet from front to back and vice versa.

Additional conventional sensors may be provided on appropriate portions of the assembly 400 to sense each time the bench 101 tilts into contact with the floor surface. Information from these sensors may be used to calculate the number of such occurrences and/or the time between such occurrences. Various exercise routines may be developed and/or encouraged with reference to tilting toward or away from one or both sides, for example. Another sort of conventional sensor may be connected to the assembly 400 to monitor how level the bench 101 remains relative to the floor surface, and information from this sensor may be used to provide the user with a visual display of the orientation of the bench 101, and/or to urge the user to tilt the bench 101 in a certain direction or a certain pattern, for example.

Figure 11:
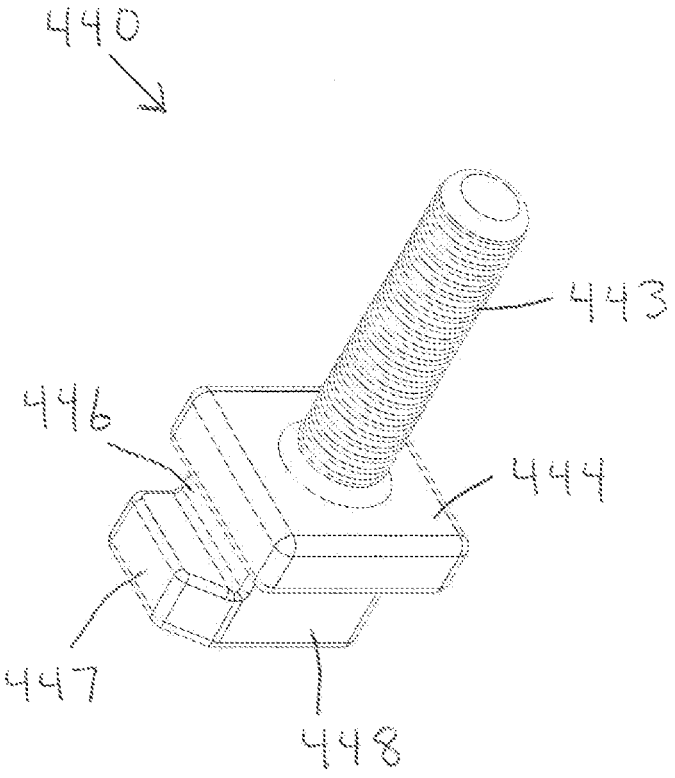
FIG. 11 is a perspective view of one component of the exercise assembly of FIG. 6.
Figure 12:
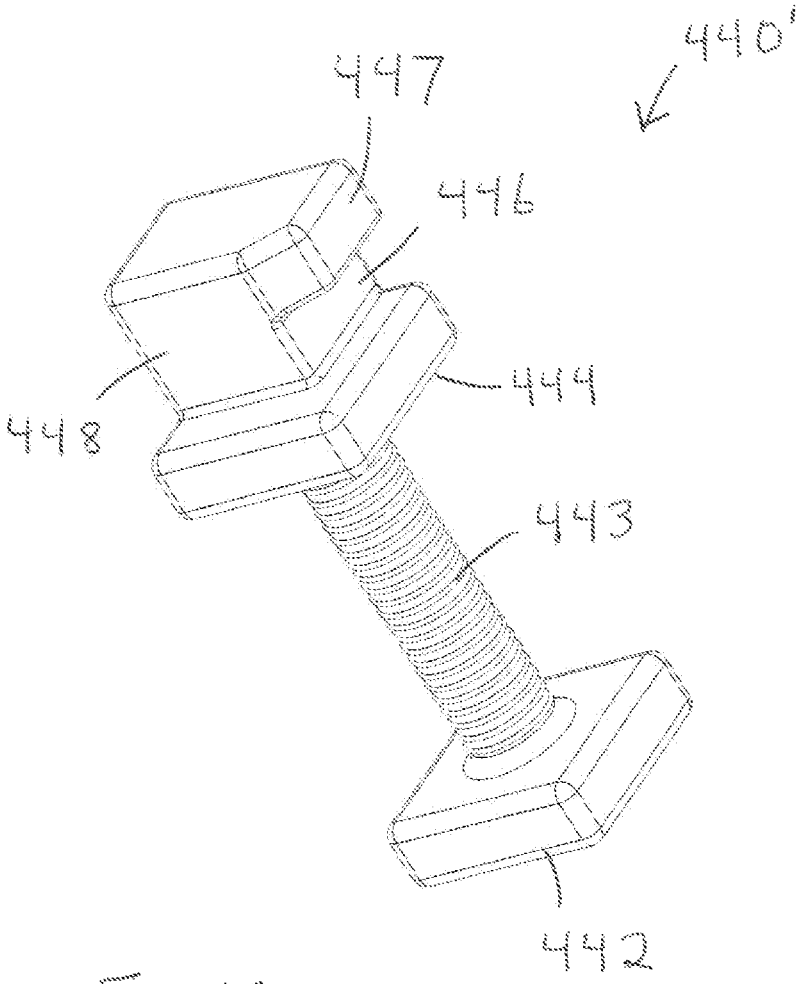
FIG. 12 is a perspective view of a modified version of the component of FIG. 11.

FIG. 12 shows another handle/stop 440' suitable for use with the bench 400. As suggested by the common reference numerals, the handle/stop 440' is similar in many respects to the handle/stop 440 shown in FIG. 11. As shown in FIG. 12, the handle/stop 440' is preferably a blow-molded plastic part having a handgrip portion 443 that extends between a block portion 444 and an opposite, block portion 442. In addition to performing the same functions as the handle/stops 440, the handle/stops 440' also accommodate push-ups performed with respective handgrip portions 443 grasped in a person's left and right hands and extending parallel to the underlying floor surface. The blocks 442 may alternatively be configured as rectangles to provide more than one handgrip elevation as a function of the orientation of the blocks 442 relative to the floor surface.

On other embodiments of the present invention, a sub-frame or base is preferably configured to rest in a stable configuration on a floor surface, and a bench is tiltably mounted on the sub-frame. On these embodiments, left and right stops may be releasably secured between respective sides of the bench and respective sides of the base, or a single catch may be secured between one side of the bench and a corresponding side of the base. The catch may be movable into a tube or other opening to prevent the tube from moving upward or downward. Also, stabilizing handles may be mounted on the base for grasping by a person lying on the bench. In addition, different degrees of tilting may be accommodated depending on a person's level of proficiency.

The present invention may also be described in terms of various methods, including, for example, a method of exercise. One such method involves providing an exercise assembly that includes a bench capable of tilting leftward and rightward, a left foot support movably mounted on a first end of the bench, and a right foot support movably mounted on the first end of the bench; positioning the bench on a floor surface to define an upwardly facing back supporting surface at a height above the floor surface; occupying a supine position on the back supporting surface, with one's left foot on the left foot support, and one's right foot on the right foot support; using one's left arm to exert downward force against the floor surface to resist leftward tilting of the bench; using one's right arm to exert downward force against the floor surface to resist rightward tilting of the bench; and using one's left leg and one's right leg to repeatedly move the left foot support and the right foot support back and forth through at least one path of motion subject to desired resistance in at least one direction. Such a method may further involve the steps of alternatively placing one's left foot and one's right foot on the floor surface, using one's left leg to exert downward force against the floor surface to resist leftward tilting of the bench; using one's right leg to exert downward force against the floor surface to resist rightward tilting of the bench; and moving one's left arm and one's right arm up and down through at least one path of motion subject to desired resistance in at least one direction. Such a method may also involve the preliminary steps of positioning a left stop beneath a left side of the bench to prevent leftward rotation of the bench toward the floor surface; positioning a right stop beneath an opposite, right side of the bench to prevent rightward rotation of the bench toward the floor surface; and when ready to begin exercise movements, removing each said stop. Furthermore, subsequent to removal of each said stop, each said exerting step may be performed against a respective said stop apart from the bench.

The present invention may also be described in terms of a method of exercise that involves providing an exercise assembly that includes a bench capable of tilting leftward and rightward; positioning the bench on a floor surface to define an upwardly facing back supporting surface at a height above the floor surface; positioning a left stop beneath a left side of the bench to prevent leftward tilting of the bench toward the floor surface; positioning a right stop beneath an opposite, right side of the bench to prevent rightward tilting of the bench toward the floor surface; occupying a supine position on the back supporting surface; when ready to begin exercise movements, removing each said stop from beneath a respective said side of the bench; in a first mode of operation, using one's left arm to exert downward force against the floor surface to resist leftward tilting of the bench; using one's right arm to exert downward force against the floor surface to resist rightward tilting of the bench; and moving one's left leg and one's right leg subject to desired resistance; and in an alternative, second mode of operation, using one's left leg to exert downward force against the floor surface to resist leftward tilting of the bench; using one's right leg to exert downward force against the floor surface to resist rightward tilting of the bench; and moving one's left arm and one's right arm subject to desired resistance. In the first mode of operation, each said using step may be performed using a respective said stop apart from the bench.

The present invention has been described with reference to particular embodiments and specific applications with the understanding that this disclosure will enable persons skilled in the art to derive various alternative embodiments and applications, including combinations of features from discrete embodiments and/or obvious substitutions of elements. Accordingly, the scope of the subject invention should be limited only to the extent of the allowed claims.

What is claimed is:

1. An exercise assembly, comprising:

an exercise bench defining an upwardly facing back supporting surface disposed at a height above an underlying floor surface, and having a left side and an opposite, right side that define a width therebetween, measured perpendicular to the height, and a first end and an opposite, second end that define a relatively longer length therebetween, measured perpendicular to the height and the width, wherein the back supporting surface is tiltable side-to-side relative to the floor surface;

a left pivot arm pivotally connected to the bench, proximate the first end, for pivoting about a pivot axis located on the bench, wherein said pivot axis is constrained to tilt side-to-side together with the bench;

a left foot support mounted on the left pivot arm;

a right pivot arm pivotally connected to the bench, proximate the first end, for pivoting about said pivot axis; and a right foot support mounted on the right pivot arm.

2. The exercise assembly of claim 1, further comprising a left stop and a right stop, wherein the left stop is removably braced beneath the left side of the bench to prevent tilting of the left side of the bench toward the floor surface, and the right stop is removably braced beneath the right side of the bench to prevent tilting of the right side of the bench toward the floor surface.

3. The exercise assembly of claim 2, wherein the left stop is selectively movable to a discrete position at a distance entirely leftward of the left side of the bench, and the right stop is selectively movable to a discrete position at a distance entirely rightward of the right side of the bench.

4. The exercise assembly of claim 2, further comprising a left handlebar on the left stop, and a right handlebar on the right stop, wherein each said handlebar projects outward beyond a respective said side of the bench when each said stop is braced beneath a respective said side of the bench.

5. The exercise assembly of claim 4, wherein each said stop and respective said handlebar are arranged in a first manner relative to the bench to support each said handlebar in a first orientation, extending perpendicular to the floor surface and within reach of a person lying supine on the upwardly facing back supporting surface, and alternatively are arranged in a second manner relative to the bench to support each said handlebar in a second orientation, extending parallel to the floor surface and within reach of a person lying supine of the upwardly facing back supporting surface.

6. The exercise assembly of claim 1, wherein each said pivot arm pivots between a horizontal first position, lying flat against and parallel to the upwardly facing back supporting surface, and a vertical second position, extending perpendicular to the upwardly facing back supporting surface.

7. The exercise assembly of claim 1, wherein each said pivot arm is pivotal independent of the other said pivot arm.

8. The exercise assembly of claim 1, wherein each said foot support is a bicycle pedal rotatably mounted on a respective said pivot arm.

9. The exercise assembly of claim 7, further comprising at least one left resistance member interconnected between the left pivot arm and the bench for resisting pivoting of the left pivot arm relative to the bench, and at least one right resistance member interconnected between the right pivot arm and the bench for resisting pivoting of the right pivot arm relative to the bench.

10. The exercise assembly of claim 1, further comprising a resistance assembly interconnected between the bench and each said pivot arm for resisting pivoting of each said pivot arm relative to the bench.

11. The exercise assembly of claim 1, wherein the bench defines a downwardly facing floor engaging surface that is convex and rocks relative to the floor surface in response to tilting of the bench.

12. An exercise assembly, comprising:

a tiltable exercise bench having a left side and an opposite, right side;

at least one stop removably positioned beneath at least one said side of the bench to prevent side-to-side tilting of the bench, wherein the at least one stop (a) is disposed within reach of a person lying supine on the bench, (b) is movable into and out of a braced position relative to at least one said side of the bench by at least one hand of the person lying supine on the bench, and (c) projects laterally outward beyond at least one said side of the bench when occupying the braced position; and a left pivot arm pivotally connected to the bench, proximate the first end, for pivoting about a pivot axis located on the bench, wherein said pivot axis is constrained to tilt side-to-side together with the bench; a left foot support mounted on the left pivot arm; a right pivot arm pivotally connected to the bench, proximate the first end, for pivoting about said pivot axis; and a right foot support mounted on the right pivot arm.

13. The exercise assembly of claim 12, wherein the at least one stop includes a left stop that is selectively movable between a first position, bracing a left side of the bench against tilting toward an underlying floor surface, and a second position, at a distance left of the left side and apart from at least one of the bench and the floor surface, and a right stop that is selectively movable between a first position, bracing a right side of the bench against tilting toward an underlying floor surface, and a second position, at a distance right of the right side and apart from at least one of the bench and the floor surface.

14. The exercise assembly of claim 12, wherein the at least one stop includes a handlebar configured to be grasped in a person's hand outboard from a respective said side of the bench.

15. The exercise assembly of claim 12, wherein the at least one stop is selectively latched in said braced position by a protruding structure on one of the bench and the at least one stop, and a complementary recess on an opposite one of the bench and the at least one stop.

16. The exercise assembly of claim 12, wherein the at least one stop includes a left stop selectively sandwiched directly between the floor surface and the left side of the bench to limit tilting of the left side of the bench toward the floor surface, and a right stop selectively sandwiched directly between the floor surface and the right side of the bench to limit tilting of the right side of the bench toward the floor surface.

17. An exercise apparatus, comprising:

an exercise bench having a left side and an opposite, right side that define a width therebetween, and a first end and an opposite, second end that define a relatively longer length therebetween, measured perpendicular to the width, wherein the bench defines an upwardly facing back supporting surface and a downwardly facing floor engaging surface, wherein the floor engaging surface accommodates side-to-side tilting of the back supporting surface relative to an underlying floor surface;

a left pivot arm pivotally connected to the bench, proximate the first end, for pivoting about a pivot axis located on the bench, wherein said pivot axis is constrained to tilt side-to-side together with the bench;

a left foot support mounted on the left pivot arm;

a right pivot arm pivotally connected to the bench, proximate the first end, for pivoting about said pivot axis; and a right foot support mounted on the right pivot arm.

18. The exercise apparatus of claim 17, further comprising a left stop selectively sandwiched directly between the floor surface and the left side of the bench to limit tilting of the left side of the bench toward the floor surface.

19. The exercise assembly of claim 17, wherein each said foot support is a bicycle pedal rotatably mounted on a respective said pivot arm.

20. The exercise apparatus of claim 17, wherein the left pivot arm and the right pivot arm are pivotal in opposite directions relative to one another.

21. The exercise apparatus of claim 20, further comprising at least one left resistance member interconnected between the left pivot arm and the bench for resisting pivoting of the left pivot arm relative to the bench, and at least one right resistance member interconnected between the right pivot arm and the bench for resisting pivoting of the right pivot arm relative to the bench.

* * * * *